United States Patent [19]

Bass

[11] Patent Number: 4,552,540

[45] Date of Patent: Nov. 12, 1985

[54] SWIMMING POOL EXERCISE DEVICE

[76] Inventor: Eric Bass, 10 Walton Ave., Doylestown, Pa. 18901

[21] Appl. No.: 572,267

[22] Filed: Jan. 19, 1984

[51] Int. Cl.[4] ..... A63B 69/12

[52] U.S. Cl. ..... 441/129; 441/111; 441/106

[58] Field of Search ..... 441/111, 106, 108, 112, 441/113–119, 129; 272/71, 70 A; 434/254

[56] References Cited

U.S. PATENT DOCUMENTS

| | | | |
|---|---|---|---|
| 1,329,660 | 2/1920 | Kaye | 434/254 |
| 3,512,416 | 5/1970 | Hohwart | 272/71 |
| 3,780,663 | 12/1973 | Pettit | 272/70 A |
| 3,988,020 | 10/1976 | Carter | 272/71 |
| 4,047,255 | 9/1977 | Kiefer | 441/111 |
| 4,443,204 | 4/1984 | Perrin | 441/129 |

*Primary Examiner*—Trygve M. Blix
*Assistant Examiner*—C. T. Bartz
*Attorney, Agent, or Firm*—Caesar, Rivise, Bernstein & Cohen

[57] ABSTRACT

A buoyant vest for use in a swimming pool. The vest is made of a buoyant material. The vest has first vest loops attached adjacent the shoulder portions. The vest also has second vest loops attached adjacent the waist portion thereof. Adjustabe security lines are attached between the vest loops and anchoring loops located on a frame that is detachably attached to the swimming pool.

16 Claims, 4 Drawing Figures

FIG. 1
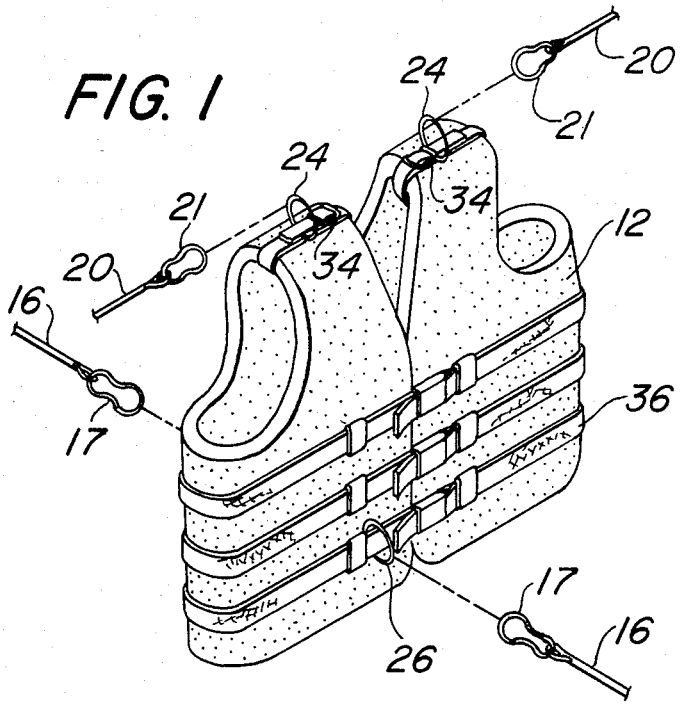
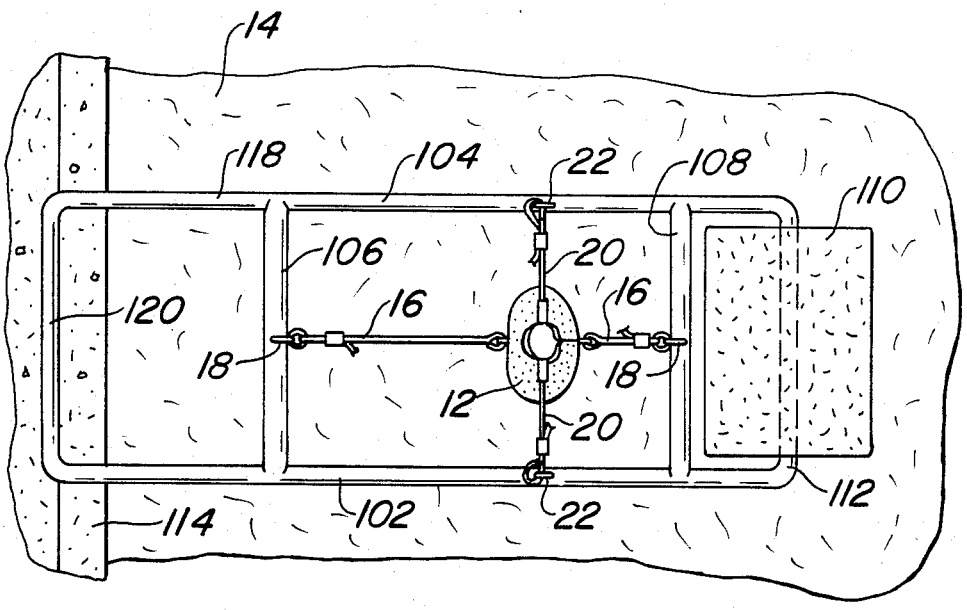
FIG. 4

SWIMMING POOL EXERCISE DEVICE

This invention relates to a swimming pool exercise device and more particularly to a new type of exercise device which can be used when a person cannot partially or fully support his or her weight.

It is known that exercise plays a very important role in maintaining good health. There are times when people are unable to partially or fully support the weight of their own body and thus vigorous exercise involving the use of legs becomes difficult or impossible.

For instance, there are various leg, hip and foot injuries normally suffered by athletes. Also, various diseases may temporarily or permanently affect the ability of a person to support his or her weight. Similar problems exist in many persons of advanced age.

In most cases the inability to support one's own weight exists because of the extreme pain encountered in the event of leg, hip and foot injuries or disease or concern for injury where a person of advantaged age has so called brittle bones. There are also situations where there is concern that there will be injury or further injury in the course of normal exercise involving the use of the legs because of the shock or stress imposed upon the legs.

It has been determined through the present invention that shock or stress can be alleviated though exercising while immersed in water. In the present invention the buoyancy effect of the water eliminates some of the weight of the person with the additional weight being taken up by a buoyant harness used the present invention and security lines which connect the buoyant harness though anchored points on or beyond the swimming pool.

The use of various holding devices for animals or humans in connection with bodies of water is known. See for instance U.S. Pat. No. 2,438,979 which shows a harness for bathing an animal in a bathtub. The harness of U.S. Pat. No. 2,438,979 involves a pair longitudinal bars detachably connected to cross bars with means at the ends of the cross bars for detachably securing the cross bars to the walls of the bathtub. A plurality of straps are adapted to be placed around the anminal's body and means are provided to support the straps on the longitudinal bars.

U.S. Pat. No. 2,788,055 involves a baby bath tub safety device which is adapted for a bath tub installed within a bath room floor and walls. The bath tub safety device involves a vertical swivel tubular bearing support with means to enable such support to be rigidly attached to the bath tub floor and the bath tub wall. A swivel tubular extension support arm is adjustably and rotatably mounted within the vertical bearing support tube with the extension support arm being designed and formed to project above and over the bath tub and downwardly to the opposite tub wall. Means are rigidly attached to the opposite tub wall edge, with such means being designed and positioned to engage and retain the extension support arm.

The extension support arm is designed and formed to project above and horizontally over the bath tub and downward to the opposite tub wall edge. Spring means are mounted within the tubular bearing support engageable with the enclosed swivel support arm end section and are designed for supporting and displacing the same from the end lock notches when released. A spring latch means is mounted on the bearing support and also positioned engageable with the support arm end section for locking and releasing same in various predetermined positions.

U.S. Pat. No. 3,835,815 relates to a therapeutic conditioner for horses and encloses a water fillable open tank. A hoist and sling assembly is provided for the purpose of lifting and holding a horse in the tank while the horse swims. Guide ropes extend from the sling assembly to the periphery of the tank. The guide ropes serve to maintain the position of the horse relative to the tank.

While the foregoing devices serve to support the body of a human or animal in water, none of them provide the necessary added buoyancy effect to relieve the highly disturbing strain of the downward body weight to permit free exercise of the legs. This is quite significant where the person is suffering pain and disease or injury. Also, with the present invention there is the elimination of shock to the legs, hips, feet and back areas.

It is accordingly an object of the present invention to provide an exercise device for use in a swimming pool which enables the carrying out of exercise when a person cannot support his or her weight.

Yet another object of the present invention is to provide an exercise device where the weight of a person is completely eliminated thereby also eliminating shock to the legs, hips, feet or back area.

Still another object of the present invention is to provide an excercise device that is economical to produce, can be readily assembled and can be conveniently disassembled and stored for further use.

The foregoing as well as other objects of the invention are aligned by providing an exercise device which basically comprises a frame attached to the side of a swimming pool and a buoyant harness to be worn by a person with the buoyant harness being supported by the frame. The buoyant harness possesses loops at the shoulders to enable securement of upper security lines to anchoring points out or beyond the swimming pool. Additional loops are provided for further securement by security lines in the opposite or other senses as compared the first named security lines.

Attention is now called to the various figures of the drawing wherein:

FIG. 1 is a three dimentional view showing the buoyant harness of the present invention as well as portions of the ends of security lines to be attached to the buoyant harness;

FIG. 4 is a top plan view of the device of FIG. 3.

Figure 2:
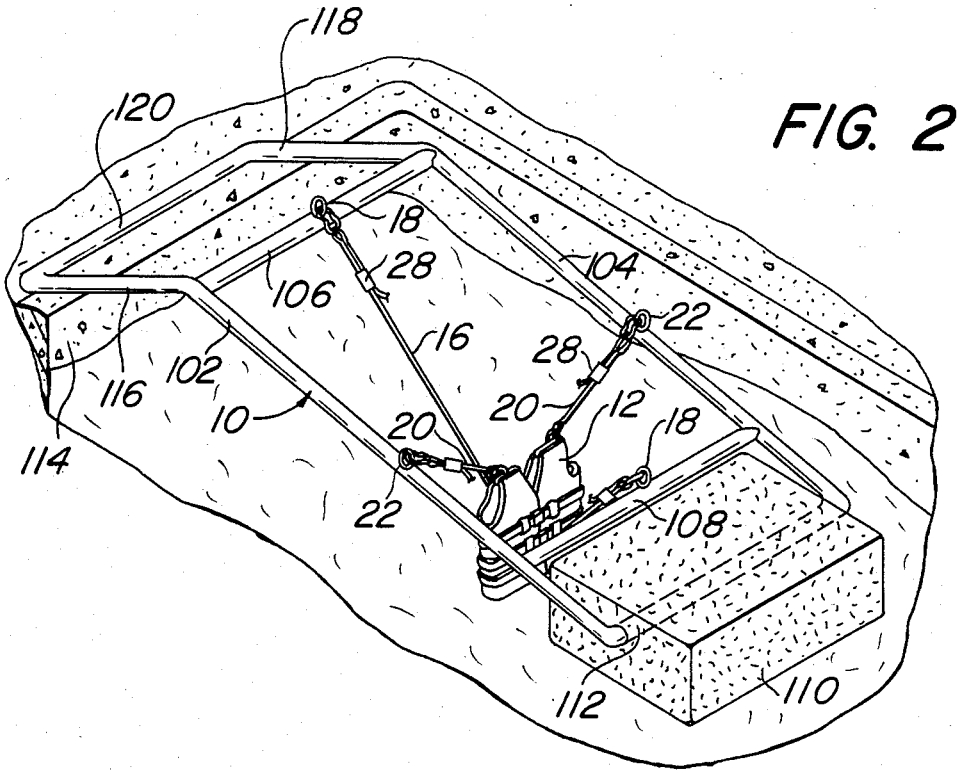
FIG. 2 is a three dimensional view partly in section showing the buoyant harness of FIG. 1 attached to the frame of the present invention with an end of the frame being secured to a side of the swimming pool and wherein the security lines are in place.

Referring now to the various figures of the drawings wherein like reference characters refer to like parts there is shown at 10 in FIG. 2 an exercise device for use in a swimming pool, comprising a specific embodiment of the present invention. As can be further seen in FIG. 2 the buoyant vest 12 is supported in the water of the swimming pool (when worn by a person).

It can be seen from FIGS. 2 and 4 that a first set of security lines 16 are provided for attachment to heavy, large anchoring loops 18 which are fixed to cross struts 106 and 108 of the frame. A second set of security lines 20 (FIG. 3) are provided for attachment to heavy, large anchoring loops 22 that are fixed to side struts 102 and 104 of the frame. The security lines are preferably made of a non-rusting metal, such as an aluminum alloy.

There are corresponding small anchoring loops on vest 12. See shoulder loops 24 and waist loops 26. Thus security lines 16 extend between loops 18 and 26 and security lines 20 extend between loops 22 and 24. Adjustment of the tension in the security lines is achieved by turnbuckles 28 or similar devices known to those in the wire or similar arts.

It should be further noted that the swimming pool is sufficiently deep so that the feet of the person wearing vest 12 do not touch the bottom of the tank.

The actual suspension of the person 12 in the swimming pool is preferrably achieved though the use of four security lines, 16 and 20 although this number of security lines and their placement may vary, depending upon the circumstances.

Figure 3:
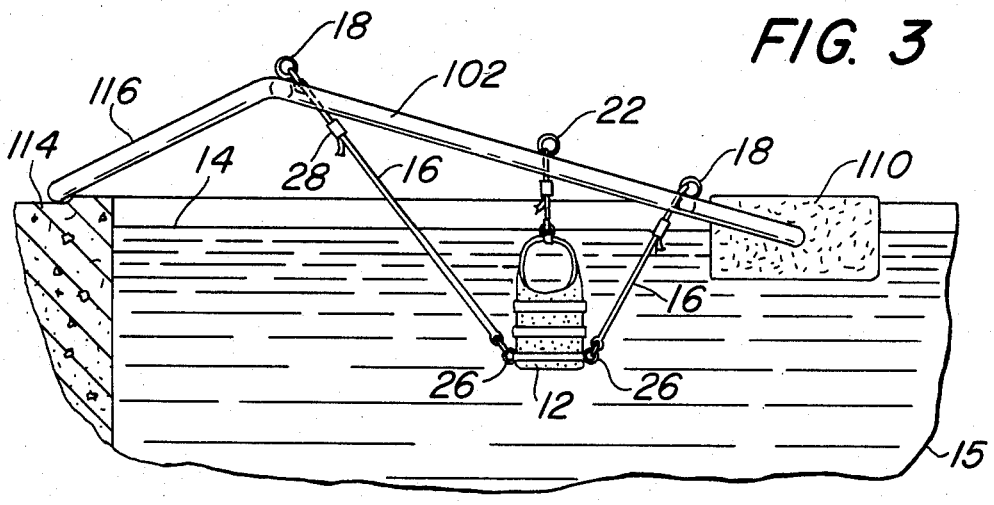
FIG. 3 is a side elevational view of the assembly of FIG. 2.

As shown in FIGS. 2 and 3 the frame comprises side struts 102 and 104 being connected by cross struts 106 and 108. The side struts extend beyond cross strut 18 to meet first end strut 112 to which is secured a floating block 110 of rigid foamed polyurethane. Struts 116 and 118 extend away from struts 102 and 104 with the struts 116 and 118 being connected by second end strut 120 which firmly engages the ledge 114 (FIG. 3) of the swimming pool where desired anchoring means for strut 120 may be provided.

As shown in FIGS. 1 and 2 the buoyant vest or harness is provided with loops 24 similar to loops 26, at the shoulder lines. As can be further seen in FIG. 1 the loops 24 are generally held in place by means of inserted straps 34 possessing buckles to enable tightening or loosening to the desired degree. Also, as seen in FIG. 1, the ends of the security lines may be provided with clasps or detachable loops 21 for securement to the vest loops 24 or 26.

Front and back loops 26 are provided as can best be seen in FIG. 2. These loops 26 are also held in place through one of the straps 36 in a manner similar to the shoulder loops 24. Clasps or detachable loops 17 for security lines 16 are similarly provided as can be seen in FIG. 1.

It is contemplated that the buoyant harness to be used in the present invention may be a conventional or specially designed harness of a material such as rigid polyurethane or rigid foamed polyurethane. An example of an conventional harness is a vest commonly used in the sport of skiing, as is generally shown in FIG. 1. Such vest is modified to have the desired number of body straps as well as providing the shoulder straps as seen in FIG. 1. The buoyant vest 12, preferrably has a buoyancy factor of at least 15.5 pounds (6.98 kilograms) and is basically of the one piece, front opening type as shown in FIG. 1.

With the foregoing arrangement a man, woman or child can be easily suspended for exercise in the swimming pool. After the vest has been secured in place to the person, the security lines are attached at the various loops 24 and 26 on the vest 12 and to at least one of the loops 18 and 22. The person then supports himself or herself by holding on to side of the frame while the security lines are engaged in the other loops 18 and 22.

The security line length can be adjusted as desired which also has the effect of adjusting the tension in each security line. Once the person is comfortable with the degree of vertical support provided by the buoyancy in the vest and the tension in the security lines, exercise can begin. The swimming pool should be sufficiently filled with water so that the legs do not touch the bottom of the tank and the person can move his or her legs completely and confidently in the water in a simulated walking or running action as well as complimentary arm movement.

The present invention may also be used with a variety of bodies of water, such as a very large tank wherein anchoring loops 18 and 22 are affixed at appropriate places along the sides of the swimming pool or tank.

From the foregoing it can be seen that the present invention enables running or walking movement of a person while completely relieving the person of the necessity to support his or her weight. Accordingly, the present invention is quite significant for use where a person cannot partially or fully support his or her own weight and eleminates all shock during exercising.

Without further elaboration, the foregoing will so fully illustrate my invention that others may, by applying current or future knowledge, readily adapt the same for use under various conditions of service.

I claim:

1. A buoyant vest for use in a swimming pool, said vest being made of a buoyant material and being adapted to be worn by a person, said vest having first vest loops attached adjacent the shoulder portions thereof and second vest loops attached adjacent the waist thereof, a frame detachably attached to a side of a swimming pool, said frame having side struts and at least one cross strut, at least one first anchoring loop attached to said cross strut, at least one second anchoring loop attached to one of said side struts, whereby adjustable security lines can be attached between one of said vest loops and one of said anchoring loops and between another of said vest loops and another one of said anchoring loops.

2. An exercise device comprising a buoyant vest and a frame detachably attached to a side of a swimming pool, said vest being made of a buoyant material and being adapted to be worn by a person, said vest having vest loops attached adjacent the shoulder portions and waist thereof, said frame having side struts and at least one cross strut, at least one first anchoring loop attached to said cross strut, at least one second anchoring loop attached to one of said side struts, whereby adjustable security lines can be attached between one of said vest loops and one of said anchoring loops and between another of said vest loops and another one of said anchoring loops.

3. The buoyant vest of claim 1 wherein said frame includes two side struts and two cross struts extending between said side struts.

4. The buoyant vest of claim 3 and further including at least one end strut extending between said side struts.

5. The buoyant vest of claim 4 wherein said end strut is secured to a floating block.

6. The buoyant vest of claim 5 including a second end strut, remote from said first end strut.

7. The buoyant vest of claim 6 wherein said second end strut family engages the ledge of a swimming pool.

8. The buoyant vest of claim 7 wherein portions of said side strut lying between one of said cross struts and said second end strut are inclined upwardly from said second end strut to said cross strut.

9. The buoyant vest of claim 8 wherein portions of said side strut extending between said first cross strut and said end strut are inclined to move upwardly from said end strut to said cross strut.

10. The exercise device of claim 2 wherein said frame includes two side struts and two cross struts extending between said side struts.

11. The exercise device of claim 10 and further including at least one end strut extending between said side struts.

12. The exercise device of claim 11 wherein said end strut is secured to a floating block.

13. The exercise device of claim 12 including a second end strut, remote from said first end strut.

14. The exercise device of claim 13 wherein said second end strut firmly engages the ledge of a swimming pool.

15. The exercise device claim 14 wherein portions of said side strut lying between one of said cross struts and said second end strut are inclined upwardly from said second end strut to said cross strut.

16. The exercise device of claim 15 wherein portions of said side strut extending between said first cross strut and said end strut are inclined to move upwardly from said end strut to said cross strut.

* * * * *